United States Patent [19]

Cummings

[11] Patent Number: 4,863,174

[45] Date of Patent: Sep. 5, 1989

[54] BALL CATCHER AND THROWER

[75] Inventor: Gerald W. Cummings, Wantaugh, N.Y.

[73] Assignee: Ned Strongin Creative Services, New York, N.Y.

[21] Appl. No.: 266,939

[22] Filed: Nov. 3, 1988

[51] Int. Cl.[4] ..... A63B 67/00

[52] U.S. Cl. ..... 273/322; 273/412

[58] Field of Search ..... 273/322, 317, 318, 326, 273/412

[56] References Cited

U.S. PATENT DOCUMENTS

| | | | |
|---|---|---|---|
| D. 183,084 | 6/1958 | Carlson | D34/5 |
| 1,582,811 | 4/1926 | Adler | 273/322 |
| 2,025,995 | 12/1935 | Lerch | 273/322 |
| 2,505,090 | 4/1950 | Berry | 273/322 |
| 2,510,403 | 6/1950 | Krupp | 273/322 |
| 3,392,978 | 7/1968 | Wiest, Jr. | 273/322 |
| 3,697,074 | 10/1972 | Duncan | 273/DIG. 12 X |
| 4,045,027 | 8/1977 | Manska | 273/322 |

FOREIGN PATENT DOCUMENTS

| | | | |
|---|---|---|---|
| 808429 | 7/1951 | Fed. Rep. of Germany | 273/322 |
| 392655 | 10/1908 | France | 273/322 |

*Primary Examiner*—William H. Grieb

*Attorney, Agent, or Firm*—Richard M. Rabkin

[57] ABSTRACT

Disclosed is a hand-held catching and throwing device for maintaining an aerial projectile, such as a ball, in continuous flight or motion. The device includes an elongated, rigid, transparent double-ended tube providing a passage for receiving and projecting a projectile at or from either end, and a scoop-shaped throwing and catching member attached to each end of the tubular member and having a curved surface over which the projectile may be directed at or from an open end of the tubular member by baton-like manipulation.

13 Claims, 2 Drawing Sheets

BALL CATCHER AND THROWER

BACKGROUND OF THE INVENTION

The present invention relates generally to toys and more particularly to hand-held throwing and catching devices for maintaining a spherical object, such as a ball, in continuous motion through the exercise of dexterity, coordination and skill.

In toys of the kind designed to keep a spherical body or ball in play by one or more players, the game apparatus for tossing and catching the ball has taken a variety of forms, one class of which generally comprises a curved guide having a semi-circular crosssection and a ball-receiving funnel at one of two upturned ends. Examples of this class of game apparatus are described in U.S. Pat. Nos. 2,510,403 to E. J. Krupp, 3,392,978 to W. H. Wiest, Jr., and 4,045,027 issued to Wayne E. Manska. With this type of thrower and catcher a ball in ballistic flight may be caught in the funnel and delivered therefrom to the guide under the momentum acquired in its flight to the funnel and thrown or ejected from the other end of the guide with a minimum of manual effort. To insure that the device be capable of smoothly and efficiently receiving and directing a ball along its surface much attention is given to the curvature and the flare of the sidewalls so as to minimize the tendency of the ball to ricochet and spiral from one side of the funnel to the other as it traverses from the wide to the narrow end of the funnel.

A variation on the funnel-type of thrower and catcher described in U.S. Pat. No. 2,025,995 to Lerch consists of a cage having a generally funnel shape and includes wire bracing members extending from a ring at the mouth of the funnel to a ring adjacent the exit end. The funnel mouth has a much larger diameter than the exit end and is covered with resilient rubber fingers which deflect to allow the ball to enter but which prevent the ball from leaving by way of the mouth of the funnel. Thus, just as is the case of the other three funnel-like devices discussed above, the funnel end is utilized exclusively for catching and the other end is used exclusively for throwing.

Another game device of this general type which uses a cup instead of a funnel to catch and receive the ball is described in U.S. Pat. No. 1,582,811 issued to Milton D. Adler. This patent is directed to a ball thrower and catcher embodying a rigid trackway which is generally straight except for an upwardly curved end portion adapted to project a ball into space in a direction to permit it to be caught in a cup secured to the other end of the trackway. Thus, this device is incapable of maintaining a ball in continuous flight or motion because after being caught in the cup the ball must be released before it can again be guided down the trackway.

A ball catcher and thrower having an arcuate ball guiding track and adapted to receive or eject the ball at either end of the track is described in U.S. Pat. No. 2,505,090 issued to William L. Berry. The arcuate track consists of a bottom rail and two upper side rails each formed of wire and connected to each other by stiffening members. The side rails may extend over their entire length parallel to each other, but preferably they flare outwardly at the ends to increase the area of the catching and throwing surface. The toy is manipulated by a hand grip oositioned equidistant from the ends of the track and fixedly secured to the track-forming wires.

A fundamental problem in the design of apparatus of this type is to provide a catching surface having a shape adapted to receive a ball in ballistic flight and which will smoothly and progressively change the direction of the ball. A general object of the present invention is to provide a ball catching and throwing device which satisfies this design criteria with a structure that is simpler and thus more easily manufactured than prior art game apparatus.

Another object of the invention is to provide an improved ball throwing and catching device which enables a player to maintain a ball in continuous flight depending on his dexterity and ability to repeat the cycle of tossing and catching the ball.

Another and more specific object of the invention is to provide a hand-held ball throwing and catching device consisting essentially of a straight elongated tubular member having a scoop-shaped catcher at each end having a curved surface over which a ball may be directed at or from the open end of the tubular member by baton-like manipulation of the tubular member.

SUMMARY OF THE INVENTION

Briefly, in the ball throwing and catching device according to the invention a straight, rigid elongated open-ended tubular member formed of transparent material provides an enclosed smooth passage for receiving and discharging an aerial projectile, such as a ball, at or from either end thereof, and has an outwardly extending scoop-shaped throwing and catching member attached to each end for providing a curved surface over which the projectile may be directed at or from the open end of the tubular member by baton-like manipulation. Typically, the tubular member may be about eighteen inches long and about one and one-half inches in diameter and is made from a clear high-impact plastic so that the position of the projectile while in the tube may be observed. In use, the player grasps the tube at about its mid-point, and a projectile, typically a rubber ball of a size to readily pass through the tube, is placed on one of the throwing and catching members. When the tube is tipped by twisting the wrist, the ball rolls rapidly through the tube and onto the upwardly curved surface of the scoop at the other end from which it may be propelled upwardly by reverse twisting of the wrist. In a one player version of the game, the player attempts to catch the ball in flight in the other scoop and, if successful, repeats the cycle. In a game involving two or more players, one player "passes" the ball to another to be caught on a similar toy.

Other objects, features and advantages of the invention, and a better understanding of its construction and operation will be had from the following detailed description taken in conjunction with the accompanying drawings.

DESCRIPTION OF THE PREFERRED EMBODIMENT

Figure 1:
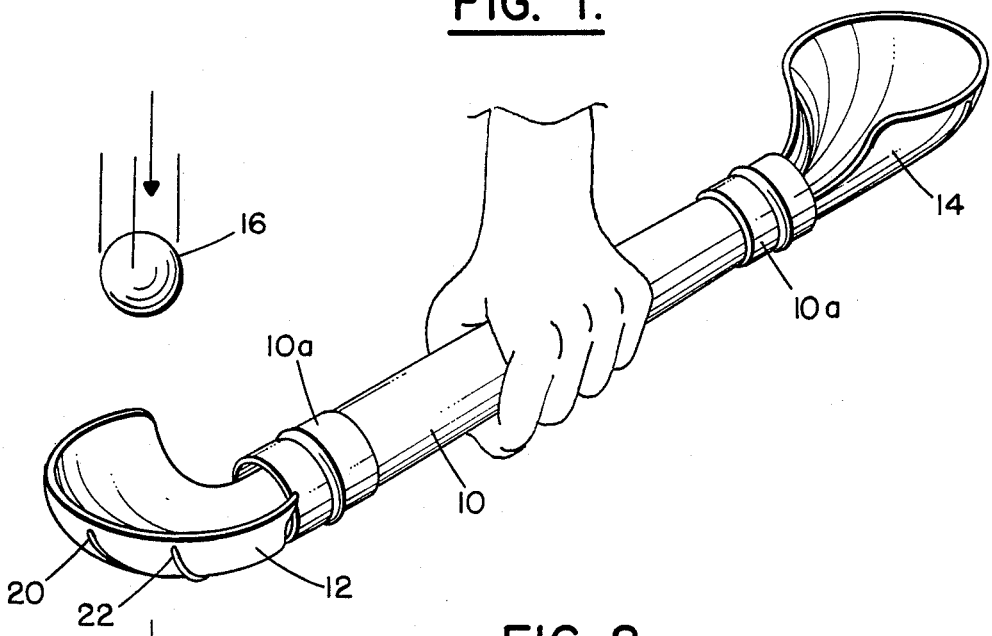
FIG. 1 is a perspective view showing the toy in use.

Referring to the drawing, the combined ball throwing and catching device according to the invention consists essentially of a straight tubular open-ended member 10 having a uniform circular cross-section throughout its length. The tube is preferably formed of a clear high-impact plastics material so that the player may observe the position of the ball therein and typically is about eighteen inches long and about one and one-half inches in diameter and has a wall thickness on the order of 0.062 inch. The tube may be fabricated in any of a number of ways, such as by blow molding it in one piece, or by extrusion. A pair of throwing and catching members 12 and 14 of like construction are secured to opposite ends of tube 10 and as illustrated both present an upwardly concave scoop-shaped surface which is symmetrical about a collinear extension of the longitudinal axis of the tubular member over which a ball 16 may be directed at or from an open end of the tube by manipulating the tubular member in baton-like fashion.

Figure 4:
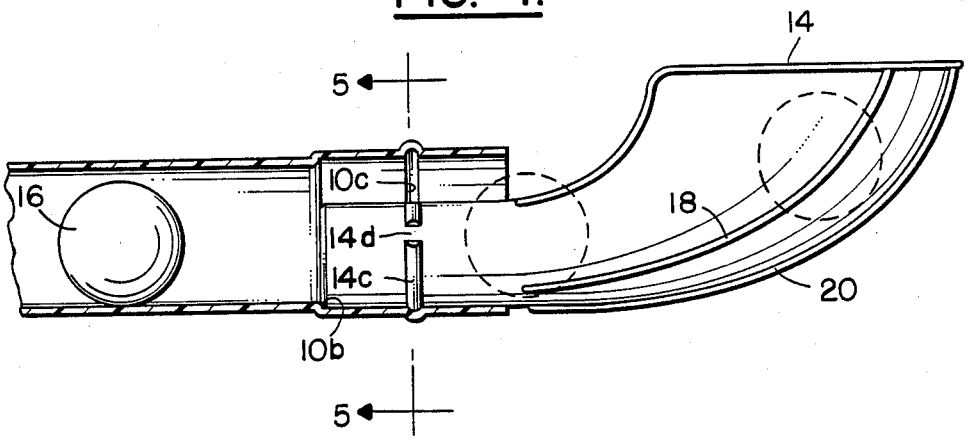
FIG. 4 is a view of one end of the toy with the tubular portion shown in cross-section and the catcher shown in elevation.
Figure 5A:
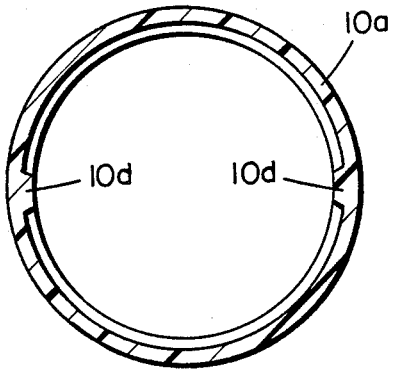
FIG. 5A is a sectional view of the tubular member taken along line 5—5 in FIG. 4.
Figure 5B:
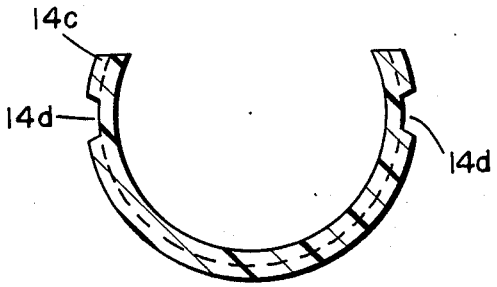
FIG. 5B is a sectional view of the catcher taken along line 5—5 in FIG. 4.
Figure 6:
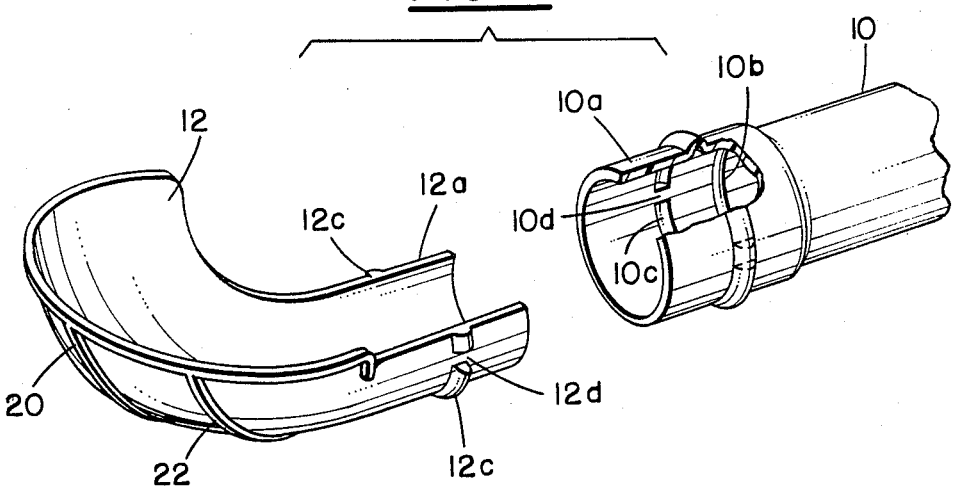
FIG. 6 is an expanded, partially cut away perspective view illustrating the attachment of the catcher to the tubular member.

The catchers are preferably injection molded from polypropylene or similar material, they typically have a wall thickness of 0.045 inch and, as best seen in FIGS. 4 and 6, have a semi-circular cylindrical inner portion **12*a* having an outside diameter substantially equal to the inside diameter of a portion 10*a* at each end of tube 10. The diameter of end portions 10*a* is slightly larger than the diameter of the major intermediate portion so as to form an internal circumferential shoulder 10*b* having a height substantially equal to the wall thickness of portion 12*a* of the catcher. Portion 12*a* of the catcher and end portions 10*a* of the tube are substantially equal in length so that when the catcher is assembled with the tube the inner end of section 12*a* abuts the shoulder 10*b* to provide a smooth transition from the surface of the catcher to the interior of the tube, and the extremity of end portion 10*a* engages the catcher where it begins to flare upwardly, at point 12*b***.

As shown in FIG. 6, the catchers are detachably secured to opposite ends of tube 10 by engagement of a circumferential ridge **12*c*, typically one-sixteenth inch high, formed on the semi-cylindrical portion 12*a* of the catcher, with a mating circumferential groove 10*c* formed in the inner wall of end portion 10*a* inwardly from its outer end; portion 12*a* is sufficiently flexible as to be compressed and inserted into end portion 10*a* and when released when fully inserted to cause ridge 12*c* to be snapped into engagement with groove 10*b*. Preferably, both catchers face in the same direction, but another dimension may be added to the game by positioning the catchers to face in different directions. To this end circumferential rib 12*c* is formed with diametrically opposed recesses or gaps 12*d* which are dimensioned to receive diametrically opposed projections formed in the groove 10*c*, whereby the catchers can be assembled with one facing up and the other down. Alternatively, rotation of the catchers relative to the tube can be prevented and the adjustability of the relative positions of the catchers enhanced by providing mating longitudinally extending serrations or teeth on portion 12*a* of the catcher and the inner surface of end portion 10*a***.

Figure 3:
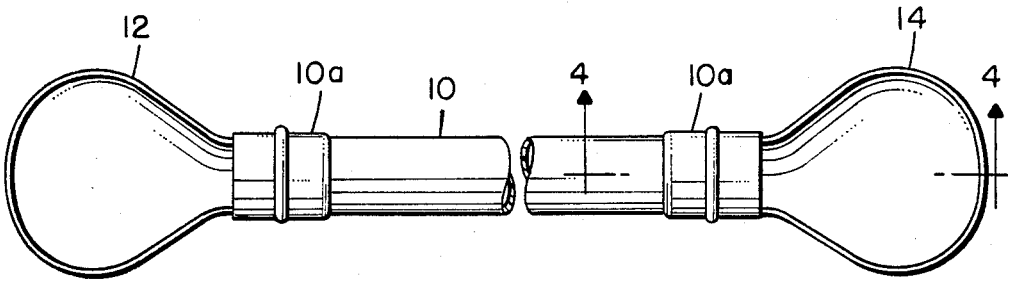
FIG. 3 is a top view of the toy.

As best seen from the plan view of FIG. 3, the outer rim of the catcher is generally circular in shape and has a radius approximately twice that of tube 10, and as shown in FIG. 4, is curved upwardly toward the outer end so as to provide a smooth, upwardly concave, scoop-shaped surface, having an area large compared to the size of the ball, over which the ball may be directed either into or from the open end of the tube. At its inner end the catcher has a radius substantially equal to that of tube 10 which becomes progressively larger towards the outer end, in both the longitudinal and transverse directions, thereby to provide a smooth and gradual transition from the relatively large opening of the catcher to the open end of the tube. The catchers are molded with three integral stiffening ribs 18, 20 and 22 which extend from the outer end of semi-circular cylindrical portion **12*a*** to the outer rim; for the indicated wall thickness of 0.045 inch the ribs may be on the order of 0.060 inch thick.

Figure 2:
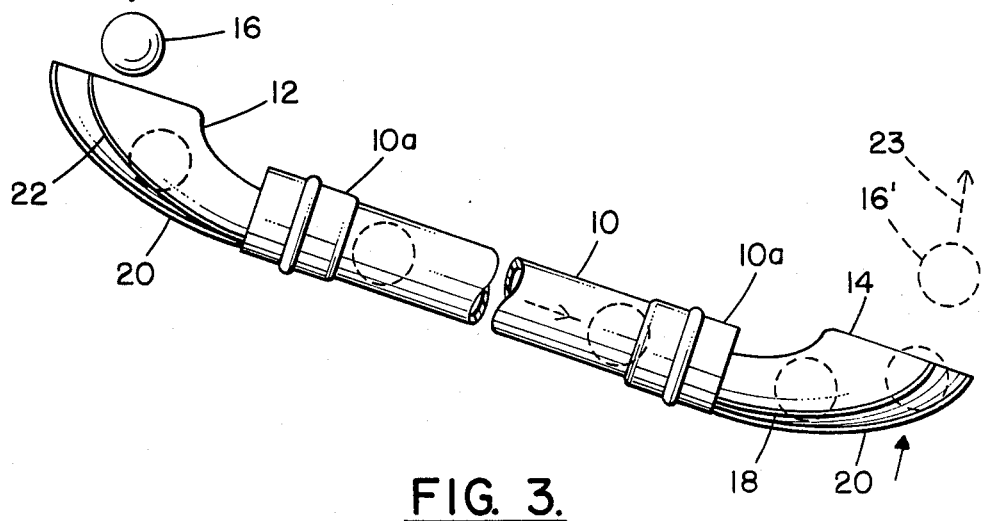
FIG. 2 is a side view of the toy showing the travel of the ball therein.

In use, a player grasps the center of the tube 10 and by twisting the wrist manipulates the toy into a position such that a caught ball 16 contacts the upwardly facing surface of the scoop tangentially, as depicted in FIG. 2, so as to be directed along the surface with a minimum of bounding and rebounding from the guiding surface. With the tube tipped to the inclined position shown in FIG. 2, the ball rolls rapidly through the smooth interior of the tube to the other catcher, from which it is propelled outwardly and upwardly, by reverse twisting of the wrist, along a trajectory indicated by the dotted-line arrow 23. The player attempts to catch the ball while in flight with the other catcher, the object being to maintain the ball in continuous flight or motion. In a game involving two or more players equipped with the described toy, one player may "pass" the ball to another who, in turn, "passes" it back to the first or to another player, the object again being to keep the ball in continuous flight or motion. In other variations of the game, the ball may be bounced off a wall and caught, or it may be passed to multiple players in a particular order.

It now should be apparent that the present invention provides a simple mechanical assembly of a straight rigid tubular member having a scoop-shaped member secured to each end constructed and arranged to catch, at either end, a ball in ballistic motion and smoothly and efficiently direct it into and through the tubular member for projection from the scoopshaped member at the opposite end.

Although an exemplary embodiment of the inventive toy is disclosed and described, it will be understood that other mechanical arrangements are possible and that the disclosed embodiment may be subjected to changes, modifications and substitutions without necessarily departing from the spirit of the invention. For example, instead of assembling a pair of scoops with a previously fabricated tubular member, a lengthwise lower half of the tube can be injection molded integrally with the scoop-shaped catcher and a separately molded top half glued or otherwise joined to the lower half.

I claim:

1. A device for catching and throwing an aerial projectile comprising:

a straight, rigid, elongated tubular member providing an enclosed double-ended passage for receiving and discharging a projectile at or from either end thereof, and a pair of throwing and catching members, one attached to and extending outwardly from each end of said tubular member and each having a scoop-shaped catching and throwing surface which is symmetrical about a center line collinear with the longitudinal axis of said tubular member and has an inner end which is substantially semi-circular in cross-section and has a radius substantially equal to the radius of said tubular member which becomes progressively larger towards the outer end of said member in both the longitudinal and transverse directions for forming a generally circular opening and a smooth transition from said opening to the open end of the tubular member for directing a projectile at or from an open end of the tubular member by hand-manipulation of the tubular member.

2. A device according to claim 1 for catching and throwing a ball, wherein said tubular member is transparent whereby the position of a ball therealong is visible and has a uniform circular crosssection throughout its length of a diameter sufficiently larger than the diameter of the ball to allow the ball to readily pass therethrough.

3. A device according to claim 2, wherein an equal length portion at each end of said tubular member has an inside diameter slightly larger than that of the major intermediate portion thereby to form an internal circumferential shoulder positioned inwardly from the end of the tubular member, and wherein the inner end of each throwing and catching member is generally semi-circular and has an outer diameter substantially equal to the inner diameter of said end portions, and a wall thickness substantially equal to the height of said shoulder so as to be received in an end portion in abutting relation with said shoulder for providing a smooth transition from the throwing and catching member to the tubular member.

4. A device according to claim 3, wherein the generally semi-circular portion of each throwing and catching member has an external circumferential rib thereon for engaging a mating circumferential groove formed in the inner surface of each end portion of said tubular member, and wherein said rib and said groove include cooperating means for preventing rotation of said throwing and catching members relative to said tubular member.

5. A device according to claim 4, wherein said means for preventing relative rotation comprises circumferentially spaced gaps in said rib dimensioned to engage correspondingly spaced projections formed in said mating circumferential groove, said gaps and projections being circumferentially distributed relative to said surface of the throwing and catching member so as to enable assembly of said device with the throwing and catching members facing in different directions.

6. A device according to claim 4, wherein both throwing and catching members face in the same direction.

7. A catching and throwing device according to claim 1, wherein said throwing and catching members are detachably attached to the ends of said tubular member.

8. A device for catching and throwing a ball comprising:

a straight, rigid, transparent elongated tubular member of uniform circular cross-section throughout its length for providing a double-ended passage for receiving and discharging a ball at or from either end thereof, said tubular member having an internal circumferential shoulder positioned inwardly from each end by the same distance to form equal-length end portions having an inside diameter slightly larger than that of the intermediate portion, and a pair of throwing and catching members, one attached to and extending outwardly from each end of said tubular member and each having a curved scoop-shaped throwing and catching surface which is symmetrical about a center line collinear with the longitudinal axis of said tubular member and each having an inner end which is generally semi-circular in cross-section and has an outer diameter substantially equal to the inner diameter of said end portions which becomes progressively larger towards its outer end in both the longitudinal and transverse directions, said inner end having a wall thickness substantially equal to the height of said shoulder so as to be received in an end portion of said tubular member in abutting relation with said shoulder for providing a smooth transition from the curved surface of the throwing and catching member to the tubular member for directing a ball at or from an open end of the tubular member by hand-manipulation of the tubular member.

9. A catching and throwing device according to claim 8, wherein the semi-circular inner end of each throwing and catching member has means formed thereon for engaging mating means formed on the end portions of said tubular member for enabling assembly of the throwing and catching members with the tubular member at selected relative angular positions and preventing rotation of said throwing and catching members relative to said tubular member from their assembled positions.

10. A catching and throwing device according to claim 9, wherein the semi-circular inner end of each catching and throwing member has an external circumferential rib for engaging a mating circumferential groove formed in the inner surface of each end portion of said tubular member.

11. A catching and throwing device according to claim 10, wherein said external circumferential rib has circumferentially distributed gaps formed therein dimensioned to engage correspondingly circumferentially distributed projections formed in said mating circumferential groove for preventing rotation of said throwing and catching members relative to said tubular member.

12. A catching and throwing device according to claim 9, wherein said throwing and catching members are assembled to both face in the same direction.

13. A catching and throwing device according to claim 8, wherein said throwing and catching members are detachably attached to the ends of said tubular member.

* * * * *